United States Patent [19]

Gauthier

[11] 4,192,426

[45] Mar. 11, 1980

[54] CLOTHES LINE DEVICE

[76] Inventor: Roland Gauthier, 100 Springdale Pl. Apt. 114, Dollard des Ormeaux, Quebec H9B 1N5, Canada

[21] Appl. No.: 904,390

[22] Filed: May 10, 1978

[51] Int. Cl.[2] ..... A47H 1/08

[52] U.S. Cl. ..... 211/105.4; 211/87

[58] Field of Search ..... 211/105.4, 105.3, 105.5, 211/86, 87, 119.01, 119.1; 108/42, 148; 248/264, 302, 354.5, 355, 356; 292/259, DIG. 15; 4/145, 146; 188/1 R

[56] References Cited

U.S. PATENT DOCUMENTS

| | | | |
|---|---|---|---|
| 1,836,126 | 12/1931 | Luce | 211/123 |
| 2,010,596 | 8/1935 | Klandt | 211/123 |
| 2,522,174 | 9/1950 | Hermsmeyer | 211/86 |
| 2,616,569 | 11/1952 | Akers | 211/87 |
| 2,780,365 | 2/1957 | Trainor | 211/87 |
| 2,793,286 | 5/1957 | Stiffel | 248/159 X |
| 2,868,388 | 1/1959 | Crites | 211/119.1 |
| 2,964,276 | 12/1960 | Silverthorne | 248/264 X |
| 3,380,595 | 4/1968 | Klausen et al. | 211/87 |

FOREIGN PATENT DOCUMENTS

| | | | |
|---|---|---|---|
| 1427988 | 1/1966 | France | 211/87 |
| 409271 | 9/1966 | Switzerland | 211/105.4 |

*Primary Examiner*—William E. Lyddane

[57] ABSTRACT

A clothes line device of the type installed indoor between the walls at the opposite ends of a bath or outdoor between a balcony railing and a building wall, and characterized by yieldable engagement with these walls and by its construction of a few simple and inexpensive parts. The clothes line device includes a rod and a pair of clothes line attachment heads fixed to the opposite ends of the rod and resiliently yieldable upon engagement with the opposite walls. Each clothes line attachment head is formed of a bow-shaped wire work having a concave side facing the corresponding wall and engaging the latter in two stages; the first stage being sufficient to support the clothes line device per se and allowing to shift it to the desired position relative to the surface of the wall, and the second stage tightening the device to operatively support the clothes.

6 Claims, 6 Drawing Figures

CLOTHES LINE DEVICE

The present invention relates to a clothes line device of the type which is installed between two opposed spaced surfaces in particular over a bath between the walls at the ends of the bath or on a balcony between a railing and a building exterior wall.

There have been proposed so far many concepts of clothes line devices of the above type wherein the opposite ends of the device rigidly contact the opposite walls. Such rigid contact or abutment is disadvantageous since it requires very critical tightening to avoid damage to the walls and is not adapted for irregularities of the wall. The clothes line devices which have been proposed so far include relatively complex and expensive components, are not necessarily easy to install, and can not be readily removed to be stored away in the periods of no use such as in the summer.

It is a general object of the present invention to provide a clothes line device of the above type which yieldably engages opposite walls and substantially avoids the abovementioned disadvantages.

It is a more specific object of the present invention to provide a clothes line device of the above type which yieldably engages opposite walls, is easily installed even without tools, can be easily removed and stowed away even without detaching the clothes line, and is made of a small number of simple and inexpensive components.

It is an object of the present invention to provide a clothes line device of the above type wherein a pair of clothes line attachment heads at the opposite ends thereof yieldably abut against the opposite walls and allow convenient installation and positioning of the clothes line device.

It is a further object of the present invention to provide a clothes line device of the above type wherein a pair of clothes line attachment heads at the opposite ends thereof yieldably abut against the opposite walls in two progressive stages of engagement whereby the first stage is sufficient to support the device and allows to shift it to the desired position relative to the surface of each wall, and the second stage tightens the device to operatively support the clothes.

The above and other objects and advantages of the present invention will be better understood with reference to the following detailed description of a preferred embodiment thereof which is illustrated, by way of example, in the accompanying drawing; in which.

Figure 1:
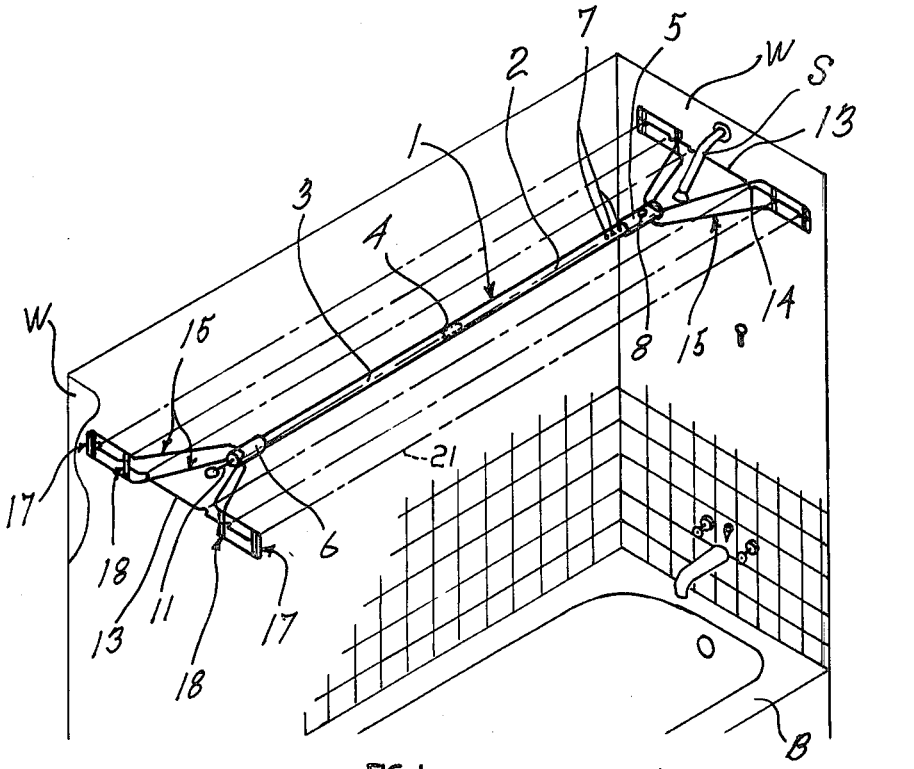
FIG. 1 is a perspective view of a clothes line device according to the present invention operatively mounted installed indoor between the walls at the opposite ends of a bath.
Figure 2:
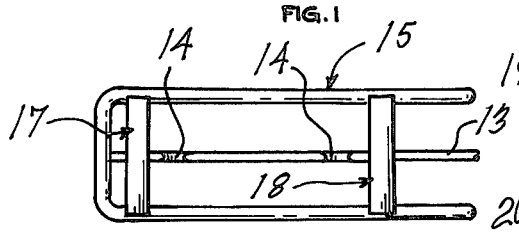
FIG. 2 is a front elevation view of one end of one clothes line attachment head forming part of the clothes line device of FIG. 1.
Figure 4:
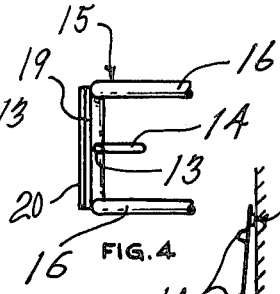
FIG. 4 is an end view as seen from the right in FIG. 2.
Figure 3:
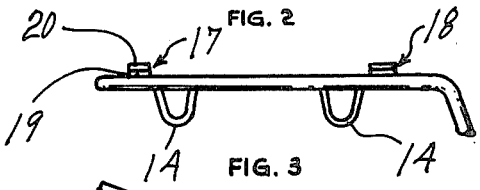
FIG. 3 is a bottom view of the elements in FIG. 2.
Figure 5:
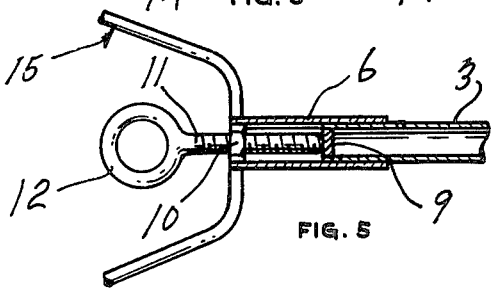
FIG. 5 is a partial cross-sectional view taken longitudinally and horizontally of the clothes line device and particularly illustrating the adjustment device to secure the clothes line device in operative position.

The illustrated clothes line device comprises an extendible stretcher unit defining opposite ends at which are secured a pair of clothes line attachment heads.

The extendible stretcher unit includes a rod 1 formed of a pair of tubular sections 2 and 3 which are engaged endwise one in the other at their inner end as shown at 4. The extendible stretcher unit also includes a pair of tube sections 5 and 6 which are fixed to the corresponding aforementioned clothes line attachment heads respectively to be bodily displaceable therewith telescopically relative to the rod 1.

The outer end of the tubular rod section 2 is provided with a series of adjustment holes 7. The tube section 5 is provided with a pin 8 which selectively engages in one of the holes 7 to provide for coarse adjustment of the overall length of the clothes line device in relation to the variations in the spacing between the walls W at the opposite ends of a bath 8.

The outer end of the tubular rod section 3 is closed by a plug 9. The outer end of the tube section 6 has a nut 10 fixedly secured therein. A screw 11 is screwed into the nut 10 to axially abut against the outer end of the tubular rod section 3.

The adjustment screw 11 is provided with an external eye portion 12 to be manually rotated through the latter.

Each clothes line attachment head includes a bow-shaped cross member of arch-shaped wire work, extending transversely relative to the rod, and defining a concave side facing away from the rod 1; that is, outwardly toward the corresponding wall W. The wire work cross member includes one clothes line attachment wire 13 extending transversely of the rod 1 and forming clothes line attachment loops 14 spaced along the length thereof and inwardly projecting on the same side as the rod 1. The arch-shaped wire work also includes a wire 15 forming a narrow frame having opposite ends secured to the opposite ends respectively of the clothes line attachment wire 13 and a longitudinally intermediate portion 16 bent away from the same clothes line attachment wire. The top and bottom wire portions of each bent portion 16 are rigidly fixed as by welding on the top and bottom respectively of the corresponding tube section 5 or 6.

Each clothes line attachment head includes an outer friction strip 17 and an inner friction strip 18 secured to each of the opposite ends of the narrow frame and fixed at their opposite ends to the top and bottom wire portions of the wire frame 15. Each friction strip 17, 18 includes a metal support strip 19 and a resilient strip 20 adhered to the support strip. A clothes line 21 is preferably laced in zig-zag manner through loops 14 of the two heads and its ends are attached to two loops 14.

The clothes line device is first assembled with or without the clothes line 21 attached to the loops 14. If required the pin 8 may be changed from one hole 7 to another to adjust the overall length of the device as aforementioned. The device is thereafter lifted into place and the screw 11 is manually rotated.

Figure 6:
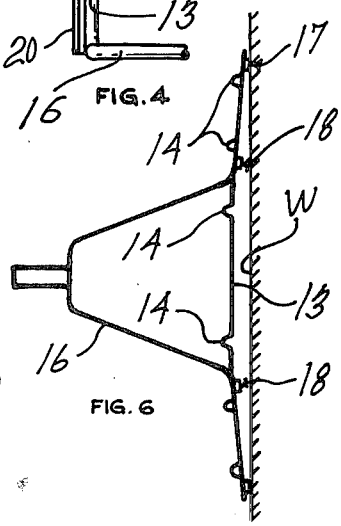
FIG. 6 is a schematic top view of one clothes line attachment head in position against one wall.

When the outer friction strips 17 engage the opposite walls W, but not the inner strips 18, a first stage is reached in which the clothes line device per se is frictionally supported while still allowing to shift the opposite ends of the device to position these ends relative to the surface of walls W. FIG. 6 illustrates this first stage.

For the second stage, the screw 11 is rotated to urge the tubular section 3 outwardly of the tube section 6 and thus extend the rod 1 until the inner friction strips 18 also engage against the walls W. Then, the clothes line device is installed to operatively support clothes thereon.

It should be noted that wire portions 16 form a pair of arms diverging away from the ends of rod 1 and form a generally triangular open frame with the central part of clothes line attachment wire 13. Said open frame has a sufficient size to clear the usual shower head S and therefore the clothes line device can be installed at any convenient level except at the level of the portion of the shower head pipe immediately entering the wall W.

The aforedescribed clothes line device may be readily removed and even disconnected at 4 for compact storage during periods of non-use such as in the summer.

It will be readily understood that changes in the details of construction may be made without departing from the spirit and scope of the present invention as defined in the appended claims. For instance, the friction strips might be replaced by rubber bands around the wire frame 15. Also, there could be more than 2 friction strips at each end of the wire frame.

What I claim is:

1. A clothes line device for mounting between opposed walls comprising an extendible stretcher unit defining a pair of opposite ends, a pair of clothes line attachment heads secured to the opposite ends respectively of said stretcher unit, each of said clothes line attachment heads including a pair of arms diverging away from the related end of said stretcher unit and a bow-shaped cross member extending transversely to said stretcher unit and secured to the outer ends of said arms, said cross member and arms forming a substantially triangular open frame for clearing a shower head extending therethrough when said cross member abuts against an adjacent wall from which the shower head protrudes, said cross-member resiliently yielding into biased engagement against the adjacent wall upon extension of said stretcher unit, each attachment head including an outer portion engaging the adjacent wall in a first position wherein said device is frictionally supported on a respective wall while allowing shifting of said device relative to the wall surface and an inner portion engaging the adjacent wall in a second position and holding said device in operative position against the adjacent wall in response to further extension of said stretcher unit.

2. A clothes line device as defined in claim 1, wherein said extendible stretcher unit includes a rod having a pair of end rod sections and an intermediate rod section removably engaging endwise one in the other, coarse length adjusting means carried by one of said end rod sections and by said intermediate section and a fine length adjusting means carried by said intermediate rod section and by said other of said end rod sections.

3. A clothes line device as defined in claim 2, wherein said fine length adjustment means includes an adjustment screw axially, threadedly engaging said other of said end rod sections and abutting against said intermediate rod section.

4. A clothes line device as defined in claim 1, wherein said extendible stretcher unit includes a rod having a pair of rod sections removably engaging endwise one in the other, the outer end of one of said rod sections has adjustment apertures therein providing selective adjustment of the corresponding clothes line attachment head longitudinally of said rod, a pair of tube sections are fixed to said clothes line attachment heads respectively, the outer ends of said rod sections are telescopically engaged in said tube sections respectively, an adjustment pin adjustably secures one tube section at the outer end of said one rod section upon selective engagement in one of said adjustment apertures, and an adjustment screw is threaded axially into one end of the other tube section and axially abuts against the outer end of the other rod section and telescopically adjusts the latter relative to said other tube section.

5. A clothes line device as defined in claim 1, wherein each of said bow-shaped cross members is of arch-shaped wire work defining an outwardly facing concave side including one clothes line attachment wire extending transversely of this stretcher unit and forming clothes line attachment loops spaced along the length thereof, and said inner and outer portions project from said arch-shaped wire work on the concave side thereof.

6. A clothes line device as defined in claim 4, wherein each of said bow-shaped cross members is of arch-shaped wire work defining an outwardly facing concave side including one clothes line attachment wire extending transversely of this stretcher unit and forming clothes line attachment loops spaced along the length thereof, said inner and outer portions project from said arch-shaped wire work on the concave side thereof, said arch-shaped wire work includes a wire forming a narrow frame having opposite ends secured to the opposite ends respectively of the clothes line attachment wire said outer portion includes an outer friction strip and said inner portion includes an inner friction strip.

* * * * *